US006290607B1

(12) United States Patent
Gilbert et al.

(10) Patent No.: US 6,290,607 B1
(45) Date of Patent: Sep. 18, 2001

(54) SET OF GOLF CLUBS

(75) Inventors: Peter J. Gilbert; Terrill R. McCabe, both of Carlsbad; Mike S. Bujdos, Oceanside, all of CA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 09/285,711

(22) Filed: Apr. 5, 1999

(51) Int. Cl.[7] ..... A63B 53/00; A63B 55/00
(52) U.S. Cl. ..... 473/291; 473/350; 473/349
(58) Field of Search ..... 473/287, 288, 473/289, 290, 291, 334, 335, 336, 337, 349, 350

(56) References Cited

U.S. PATENT DOCUMENTS

| | | |
|---|---|---|
| D. 163,961 | 7/1951 | Penna . |
| D. 164,596 | 9/1951 | Penna . |
| D. 164,597 | 9/1951 | Penna . |
| D. 188,857 | 9/1960 | Mospan . |
| D. 264,488 | 5/1982 | Kobayashi . |
| D. 323,689 | 2/1992 | Hardman et al. . |
| D. 323,690 | 2/1992 | Hlinka . |
| D. 327,109 | 6/1992 | Hardman et al. . |
| D. 332,984 | 2/1993 | Iinuma et al. . |
| D. 353,644 | 12/1994 | Hirsch et al. . |
| D. 361,358 | 8/1995 | Simmons . |
| D. 362,884 | 10/1995 | Blough et al. . |
| D. 362,885 | 10/1995 | Blough et al. . |
| D. 362,887 | 10/1995 | Blough et al. . |
| D. 364,434 | 11/1995 | McGraw et al. . |
| D. 368,753 | 4/1996 | Blough et al. . |
| D. 370,514 | 6/1996 | Blough et al. . |
| D. 383,820 | 9/1997 | Watanabe . |
| D. 386,549 | 11/1997 | Takahashi et al. . |
| D. 392,706 | 3/1998 | Stites, III . |
| D. 394,290 | 5/1998 | Best et al. . |
| D. 401,637 | 11/1998 | Best et al. . |
| D. 404,783 | 1/1999 | Best et al. . |
| D. 413,369 | 8/1999 | Peng . |
| D. 417,248 | 11/1999 | Matauo . |
| D. 432,611 | 10/2000 | McCabe et al. . |
| 1,306,029 | 6/1919 | Robertson . |
| 1,497,578 | 6/1924 | Mothersele . |
| 1,617,090 | 2/1927 | Worthington . |
| 1,917,774 | 7/1933 | Ogg et al. . |
| 1,968,627 | 7/1934 | Young . |
| 2,007,377 | 7/1935 | Link . |
| 2,062,673 | 12/1936 | Ogg et al. . |
| 2,254,528 | 9/1941 | Hoare . |
| 2,447,967 | 8/1948 | Stone . |
| 2,517,245 | 8/1950 | Scott . |
| 2,846,228 | 8/1958 | Reach . |

(List continued on next page.)

FOREIGN PATENT DOCUMENTS

| | | |
|---|---|---|
| 2 251 556 A | 7/1992 | (GB) . |
| 6-126004 | 5/1994 | (JP) . |
| 6-205858 | 7/1994 | (JP) . |
| 9-285571 | 5/1996 | (JP) . |

*Primary Examiner*—Jeanette Chapman
*Assistant Examiner*—Sneh Varma
(74) *Attorney, Agent, or Firm*—Pennie & Edmonds LLP

(57) ABSTRACT

In accordance with the present invention, a set of golf club heads is disclosed. The set includes golf club heads with a sole and a cavity back. The cavity back contains at least one mass element or cavity weight. The weight of an upper portion of the peripheral weight, the mass element of the cavity back, and the weight of the sole can be changed so that the center of gravity rises from the long irons to the short irons. The center of gravity can also be changed in a set by using a dense material on various portions of the club head. By raising the center of gravity from the long irons to the short irons, a golfer will see a peak trajectory height along a line for each club head that is substantially more consistent along that line throughout the set than prior art clubs provide.

27 Claims, 12 Drawing Sheets

U.S. PATENT DOCUMENTS

| | | |
|---|---|---|
| 3,059,926 | 10/1962 | Johnstone . |
| 3,064,980 | 11/1962 | Steiner . |
| 3,088,736 | 5/1963 | Mospan . |
| 3,143,349 | 8/1964 | MacIntyre . |
| 3,250,536 | 5/1966 | Moser . |
| 3,473,370 | 10/1969 | Marciniak . |
| 3,652,094 | 3/1972 | Glover . |
| 3,655,188 | 4/1972 | Solheim . |
| 3,703,824 | 11/1972 | Osborne et al. . |
| 3,845,955 | 11/1974 | Solheim . |
| 3,845,960 | 11/1974 | Thompson . |
| 3,941,390 | 3/1976 | Hussey . |
| 3,955,820 | 5/1976 | Cochran et al. . |
| 3,976,299 | 8/1976 | Lawrence et al. . |
| 3,995,857 | 12/1976 | Cochran et al. . |
| 3,995,858 | 12/1976 | Cochran et al. . |
| 3,995,865 | 12/1976 | Cochran et al. . |
| 4,043,563 | 8/1977 | Churchward . |
| 4,063,733 | 12/1977 | Benedict . |
| 4,085,934 | 4/1978 | Churchward . |
| 4,128,242 | 12/1978 | Elkins, Jr. . |
| 4,145,052 | 3/1979 | Janssen et al. . |
| 4,206,924 | 6/1980 | Koralik . |
| 4,211,416 | 7/1980 | Swanson . |
| 4,326,326 | 4/1982 | MacDonald . |
| 4,355,808 | 10/1982 | Jernigan et al. . |
| 4,411,936 | 10/1983 | Schrewelius . |
| 4,415,156 | 11/1983 | Jorgensen . |
| 4,420,156 | 12/1983 | Campau . |
| 4,430,230 | 2/1984 | Satake . |
| 4,502,687 | 3/1985 | Kochevar . |
| 4,558,505 | 12/1985 | Moore . |
| 4,582,321 | 4/1986 | Yoneyama . |
| 4,630,825 | 12/1986 | Schmidt et al. . |
| 4,645,207 | 2/1987 | Teramoto et al. . |
| 4,653,756 | 3/1987 | Sato . |
| 4,687,205 | 8/1987 | Tominaga et al. . |
| 4,715,601 | 12/1987 | Lamanna . |
| 4,740,345 | 4/1988 | Nagasaki et al. . |
| 4,754,969 | 7/1988 | Kobayashi . |
| 4,762,322 | 8/1988 | Molitor et al. . |
| 4,768,787 | 9/1988 | Shira . |
| 4,792,139 | 12/1988 | Nagasaki et al. . |
| 4,798,383 | 1/1989 | Nagasaki et al. . |
| 4,802,672 | 2/1989 | Long . |
| 4,824,110 | 4/1989 | Kobayashi . |
| 4,840,380 | 6/1989 | Kajita et al. . |
| 4,848,747 | 7/1989 | Fujimara et al. . |
| 4,852,880 | 8/1989 | Kobayashi . |
| 4,858,929 | 8/1989 | Long . |
| 4,874,171 | 10/1989 | Ezaki et al. . |
| 4,883,274 | 11/1989 | Hsien . |
| 4,890,840 | 1/1990 | Kobayashi . |
| 4,923,197 | 5/1990 | Schacht . |
| 4,928,972 | 5/1990 | Nakanishi et al. . |
| 4,955,610 | 9/1990 | Creighton et al. . |
| 4,957,294 | 9/1990 | Long . |
| 4,964,640 | 10/1990 | Nakanishi et al. . |
| 4,992,236 | 2/1991 | Shira . |
| 5,004,242 | 4/1991 | Iwanaga et al. . |
| 5,016,882 | 5/1991 | Fujimura et al. . |
| 5,026,056 | 6/1991 | McNally et al. . |
| 5,046,733 | 9/1991 | Antonious . |
| 5,048,834 | 9/1991 | Gorman . |
| 5,056,788 | 10/1991 | Katayama . |
| 5,062,638 | 11/1991 | Shira . |
| 5,078,400 | 1/1992 | Desbiolles et al. . |
| 5,082,278 | 1/1992 | Hsien . |
| 5,094,457 | 3/1992 | Kinoshita . |
| 5,104,457 | 4/1992 | Viljoen et al. . |
| 5,120,062 | 6/1992 | Scheie et al. . |
| 5,130,209 | 7/1992 | Das et al. . |
| 5,141,230 | 8/1992 | Antonious . |
| 5,160,136 | 11/1992 | Eger . |
| 5,160,137 | 11/1992 | Katayama . |
| 5,184,823 | 2/1993 | Desboilles et al. . |
| 5,193,805 | 3/1993 | Solheim . |
| 5,193,811 | 3/1993 | Okumoto et al. . |
| 5,209,473 | 5/1993 | Fisher . |
| 5,213,329 | 5/1993 | Okumoto et al. . |
| 5,224,705 | 7/1993 | Scheie et al. . |
| 5,226,659 | 7/1993 | Lo . |
| 5,228,688 | 7/1993 | Davis et al. . |
| 5,229,165 | 7/1993 | Das et al. . |
| 5,242,167 | 9/1993 | Antonious . |
| 5,263,718 | 11/1993 | Salheim . |
| 5,272,802 | 12/1993 | Stites, III . |
| 5,290,036 | 3/1994 | Fenton et al. . |
| 5,295,685 | 3/1994 | Solheim . |
| 5,297,794 | 3/1994 | Lu . |
| 5,297,803 | 3/1994 | Solheim . |
| 5,310,186 | 5/1994 | Karsten . |
| 5,316,297 | 5/1994 | Chappell . |
| 5,318,296 | 6/1994 | Adams et al. . |
| 5,333,872 | 8/1994 | Manning et al. . |
| 5,344,150 | 9/1994 | Schmidt et al. . |
| 5,346,213 | 9/1994 | Yamada . |
| 5,351,953 | 10/1994 | Mase . |
| 5,354,054 | 10/1994 | Akatsuka et al. . |
| 5,356,138 | 10/1994 | Chen et al. . |
| 5,362,047 | 11/1994 | Shaw et al. . |
| 5,375,840 | 12/1994 | Hirsch et al. . |
| 5,377,978 | 1/1995 | Lee . |
| 5,385,348 | 1/1995 | Wargo . |
| 5,395,113 | 3/1995 | Antonious . |
| 5,398,935 | 3/1995 | Katayama . |
| 5,401,021 | 3/1995 | Allen . |
| 5,407,202 | 4/1995 | Igarashi . |
| 5,411,264 | 5/1995 | Oku . |
| 5,413,336 | 5/1995 | Iwanaga . |
| 5,423,534 | 6/1995 | Solheim . |
| 5,423,546 | 6/1995 | Manning et al. . |
| 5,429,353 | 7/1995 | Hoeflich . |
| 5,429,357 | 7/1995 | Kobayashi . |
| 5,435,551 | 7/1995 | Chen . |
| 5,435,559 | 7/1995 | Swisshelm . |
| 5,439,222 | 8/1995 | Kranenberg . |
| 5,447,309 | 9/1995 | Vincent . |
| 5,458,334 | 10/1995 | Sheldon et al. . |
| 5,486,000 | 1/1996 | Chorne . |
| 5,509,659 | 4/1996 | Igarashi . |
| 5,522,593 | 6/1996 | Kobayashi et al. . |
| 5,524,880 | 6/1996 | Kobayashi . |
| 5,540,436 | 7/1996 | Boone . |
| 5,544,885 * | 8/1996 | Besnard et al. ..... 273/167 R |
| 5,547,194 | 8/1996 | Aizawa et al. . |
| 5,547,426 | 8/1996 | Wood . |
| 5,549,297 | 8/1996 | Mahaffey . |
| 5,562,551 | 10/1996 | Rife . |
| 5,564,705 | 10/1996 | Kobayashi et al. . |
| 5,584,770 | 12/1996 | Jensen . |
| 5,593,356 | 1/1997 | Takeda . |
| 5,599,243 | 2/1997 | Kobayashi et al. . |
| 5,607,363 | 3/1997 | Chou . |
| 5,613,917 | 3/1997 | Kobayashi et al. . |
| 5,616,088 | 4/1997 | Aizawa et al. . |
| 5,629,475 | 5/1997 | Chastonay . |
| 5,643,103 | 7/1997 | Aizawa . |
| 5,643,112 | 7/1997 | Besnard et al. . |
| 5,645,495 | 7/1997 | Saso . |
| 5,649,872 | 7/1997 | Antonious . |

| | | | | |
|---|---|---|---|---|
| 5,655,976 | | 8/1997 | Rife . | |
| 5,658,206 | | 8/1997 | Antonious . | |
| 5,658,208 | | 8/1997 | Shimasaki . | |
| 5,658,209 | | 8/1997 | Blakemore . | |
| 5,665,012 | | 9/1997 | Bunn, III . | |
| 5,669,824 | | 9/1997 | Aizawa et al. . | |
| 5,669,825 | | 9/1997 | Shira . | |
| 5,674,133 | | 10/1997 | Chang et al. . | |
| 5,683,309 | | 11/1997 | Reimers . | |
| 5,716,292 | | 2/1998 | Huang . | |
| 5,720,674 | | 2/1998 | Galy . | |
| 5,722,900 | | 3/1998 | Sung . | |
| 5,735,754 | | 4/1998 | Antonious . | |
| 5,738,596 | | 4/1998 | Meyer . | |
| 5,749,794 | | 5/1998 | Kobayashi et al. . | |
| 5,749,795 | | 5/1998 | Schmidt et al. . | |
| 5,755,624 | | 5/1998 | Helmstetter . | |
| 5,766,092 | | 6/1998 | Mimeur et al. . | |
| 5,772,526 | | 6/1998 | Hano . | |
| 5,792,004 | | 8/1998 | Nagamoto . | |
| 5,792,005 | | 8/1998 | Sieleman et al. . | |
| 5,823,887 | | 10/1998 | Mikame et al. . | |
| 5,836,830 | | 11/1998 | Onuki et al. . | |
| 5,851,157 | | 12/1998 | Koide et al. . | |
| 5,851,160 | | 12/1998 | Rugge et al. . | |
| 5,885,166 | | 3/1999 | Shiraishi . | |
| 5,890,971 | | 4/1999 | Shiraishi . | |
| 6,093,112 | * | 7/2000 | Peters et al. | 473/291 |
| 6,120,388 | * | 9/2000 | Blough et al. | 473/291 |

* cited by examiner

SET OF GOLF CLUBS

TECHNICAL FIELD OF THE INVENTION

The present invention generally relates to sets of golf clubs, and more particularly, to a set of golf club irons that provide a more consistent ball flight peak trajectory height along a line and having a center of gravity that varies for each iron in the set.

BACKGROUND OF THE INVENTION

In conventional sets of "iron" golf clubs, each club includes a shaft with a club head attached to one end and a grip attached to the other end. The club head includes a face for striking a golf ball. The angle between the face and a vertical plane is called "loft."

The set generally includes irons that are designated number 1 through number 9, and a series of wedges, such as a pitching wedge, a lob wedge, a gap wedge and a sand wedge. Each iron has a length that usually decreases through the set as the loft for each club head increases from the long irons to the short irons. The length of the club, along with the club head loft and center of gravity impart various performance characteristics to the ball's launch conditions upon impact. The initial trajectory of the ball extends between the impact point and the apex or peak of the trajectory. This initial portion of the ball's trajectory is of importance to golfers, because they can view it upon hitting the ball. Long irons, like the 2 iron, produce a more penetrating initial trajectory. Short irons, like the 9 iron or pitching wedge, produce an initial trajectory that is less penetrating than the trajectory of balls struck by long irons. The highest point of the long iron's ball flight is lower than the highest point for the short iron's ball flight. The mid irons, such as the 5 iron, produce an initial trajectory that is between those exhibited by balls hit with the long and short irons.

Since golfers see different initial trajectories with each iron number, golfers tend to change their swing from club-to-club in order to make the initial trajectory between clubs consistent. It would be desirable to have all the club heads in a set produce a consistent peak trajectory height along a line without requiring golfers to change their swing. This would allow golfers to use a consistent swing, which would likely improve their performance and confidence.

Therefore, it is desirable to provide a set of golf clubs that produce a substantially constant initial trajectory for the ball throughout the set.

SUMMARY OF THE INVENTION

In accordance with the present invention, a set of golf club heads is disclosed. The set includes golf club heads with a sole and a cavity back. The cavity back contains at least one mass element or cavity weight. The weight of an upper portion of the peripheral weight, the mass element of the cavity back, and the weight of the sole can be changed so that the center of gravity rises from the long irons to the short irons. The center of gravity can also be changed in a set by using a dense material on various portions of the club head. By raising the center of gravity from the long irons to the short irons, a golfer will see a peak trajectory height along a line for each club head that is substantially more consistent along that line throughout the set than prior art clubs provide.

DETAILED DESCRIPTION OF THE PREFERRED EMBODIMENTS

Figure 1:
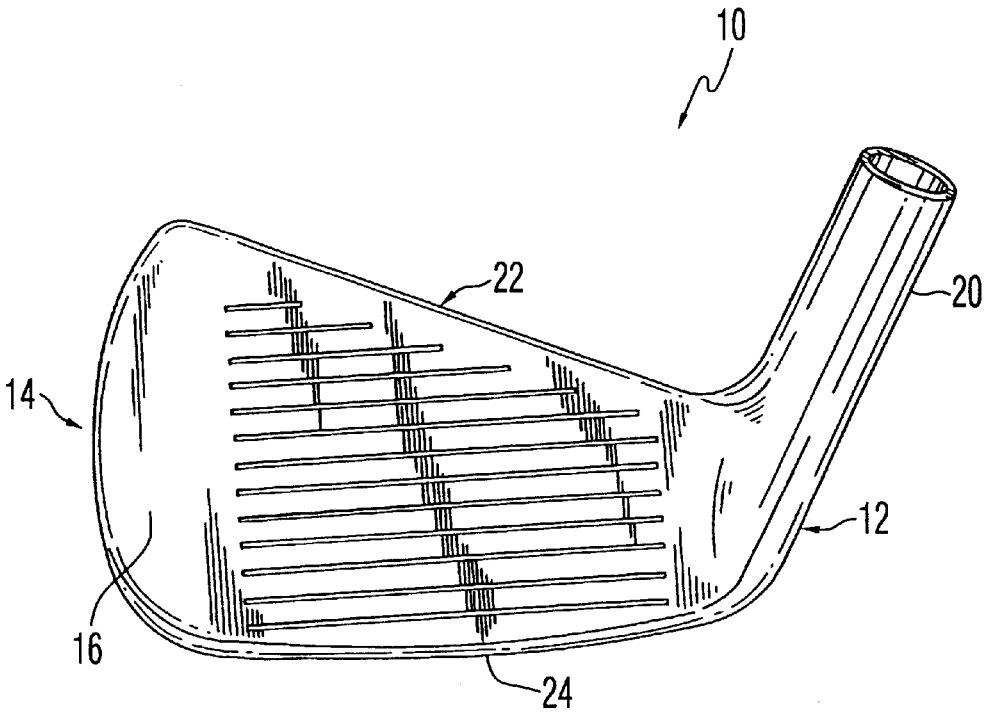
FIG. 1 is a front view of a golf club head of the present invention.
Figure 2:
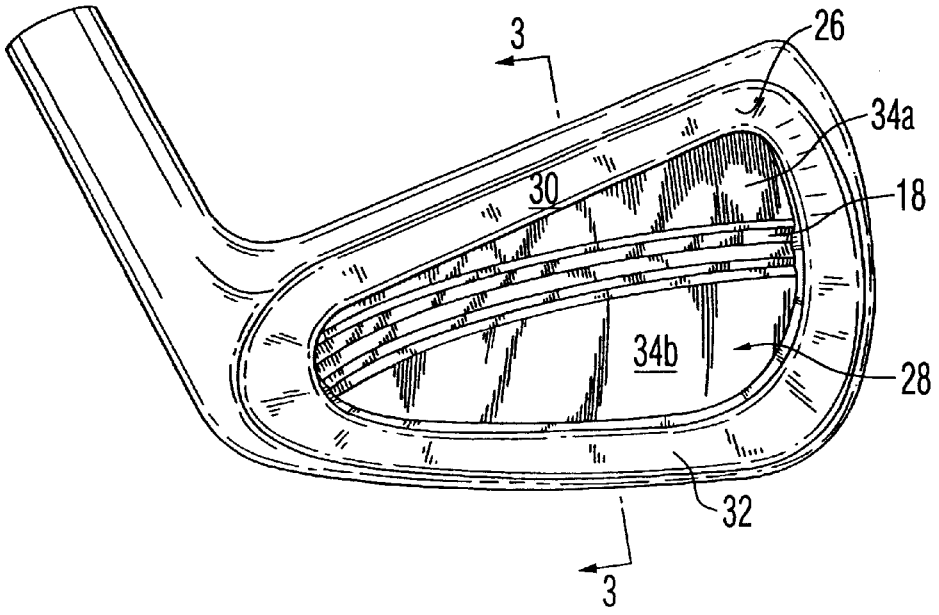
FIG. 2 is back view of the golf club head of FIG. 1.
Figure 3:
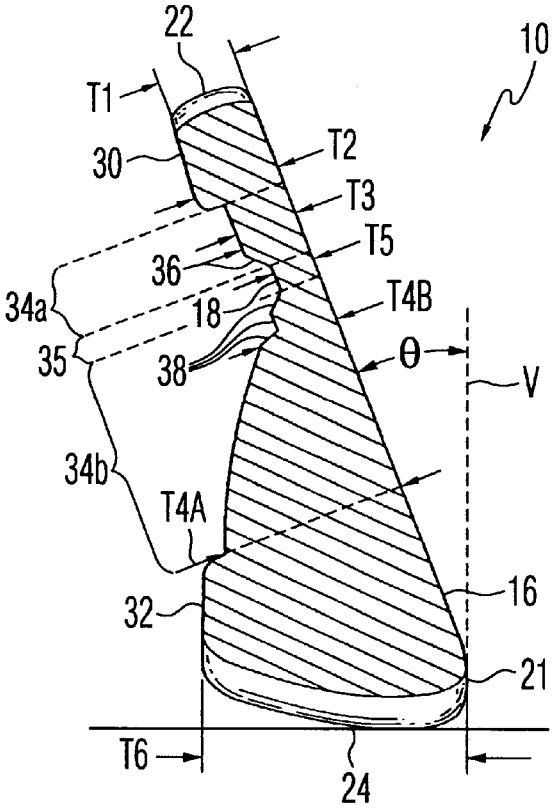
FIG. 3 is an enlarged, cross-sectional view of the golf club head taken along line 3—3 of FIG. 2.
Figure 4:
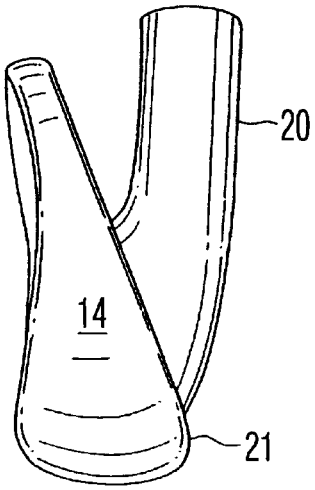
FIG. 4 is a toe-end view of the golf club head of FIG. 1.

Referring to FIGS. 1–3, an "iron" golf club head 10 is shown. The golf club head 10 includes a heel 12, a toe 14, a front face 16 and a back face 18 opposite the front face 16. A hose 20 extends from the heel 12 of the head. Referring to FIG. 4, the hose 20 in this embodiment is offset, because the front surface of the hosel is forward of the leading edge 21 of the club head. However, in another embodiment, the club head can be non-offset. Referring again to FIG. 1, the head 10 further includes an upper surface or top line edge portion 22 and a lower surface or sole 24. Both the top line 22 and the sole 24 extend from the heel 12 to the toe 14.

Referring to FIGS. 2 and 3, the back surface of the head further includes a peripheral or perimeter weight 26 that defines a cavity 28. The peripheral weight 26 has an upper portion 30 and a lower portion 32.

The cavity 28 further includes a first or upper cavity weight 34*a* and second or lower cavity weight 34*b*. The upper weight 34*a* extends from the upper portion 30 of the peripheral weight 26 toward the lower portion 32 of the peripheral weight 26. The lower weight 34*b* extends from the lower portion 32 of the peripheral weight 26 toward the upper portion 30 of the peripheral weight 26. The weights 34*a* and *b* extend from the heel 12 to the toe 14 and the lower weight 34*b* has a radius in the heel to toe direction. The upper and lower cavity weights 34*a* and *b* are spaced apart to form a gap 35 therebetween. Surface 36 of the upper weight 34*a* and surfaces 38 of the lower weight 34*b* are shaped so that the gap 35 has an arch-shape from the toe to the heel. The cavity weights 34*a* and *b* extend from the back face 18 of the head.

Referring again to FIG. 3, a number of dimensions of the club head will be discussed. The golf club head 10 includes a loft angle θ, which is the angle between the front face 16 and a vertical plane V perpendicular to the ground. The thickness of the top line 22 is designated by the arrow T1. The greatest thickness of the upper portion 30 of the peripheral weight is designated by the arrow T2. The thickness of the upper weight 34*a* is designated by the arrow T3. The thickness of the lower weight 34*b* is designated by the arrows T4A and B. The widest part of the lower weight 34*b* is designated by the arrow T4A. An intermediate thickness of the lower weight 34*b* is designated by the arrow T4B. In this embodiment, the lower weight 34*a* has dimensions so that the thickness gradually decreases between the thickness T4A and the intermediate thickness T4B. This gradual decrease allows the thicknesses T4A and B to be connected by a radius. The upper weight has a back surface which is generally parallel to the front face 16. The thickness T5 of the club head across the gap 35 is the narrowest part of the club head, and extends between the front face 16 and the back face 18. Thus, thickness T5 is the strike face thickness. By adding the peripheral and cavity weights, the thickness of the peripheral weight and cavity weights are greater than the strike face thickness. The thickness measurements T1–T5 are taken generally perpendicular to the front face 16 and between the front face 16 and the back surface of the club head. The thickness of the sole 24 is designated by the arrow T6. The thicknesses T1 and T6 are taken where the radius ends on the upper and lower surfaces.

Figure 5:
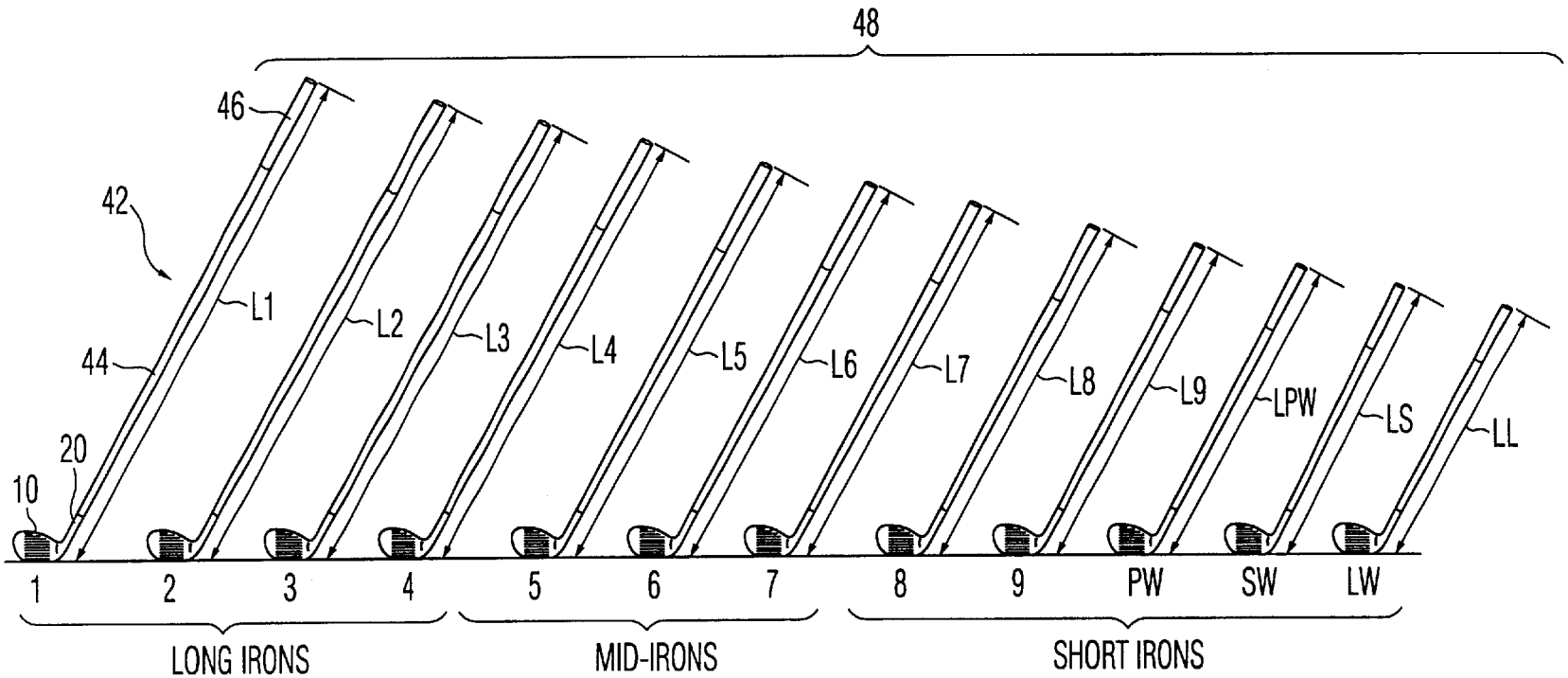
FIG. 5 is a front view of a set of golf clubs of the present invention.

Referring to FIG. 5, the golf club head 10 is shown incorporated into a golf club 42, which is a 1 iron. The golf club 42 includes a shaft 44 and a grip 46. One end of the shaft 44 is received within the hosel 20, and the other end of the shaft 44 has the grip 46 thereon. The 1 iron has a length designated L1. Each of the remaining clubs have a length L2–LL. The long-irons are the 1 iron through the 4 iron, the mid-irons are the 5 iron through the 7 iron and the short-irons are the 8 iron through the lob wedge (LW). The short irons include a series of wedges including the pitching wedge PW, the sand wedge SW and the lob wedge LW. FIG. 5 illustrates that from the long irons to the short irons in a set of clubs 48, the length of the clubs decreases from the long irons to the short irons. The lie angle between clubs can also vary.

Figure 6:
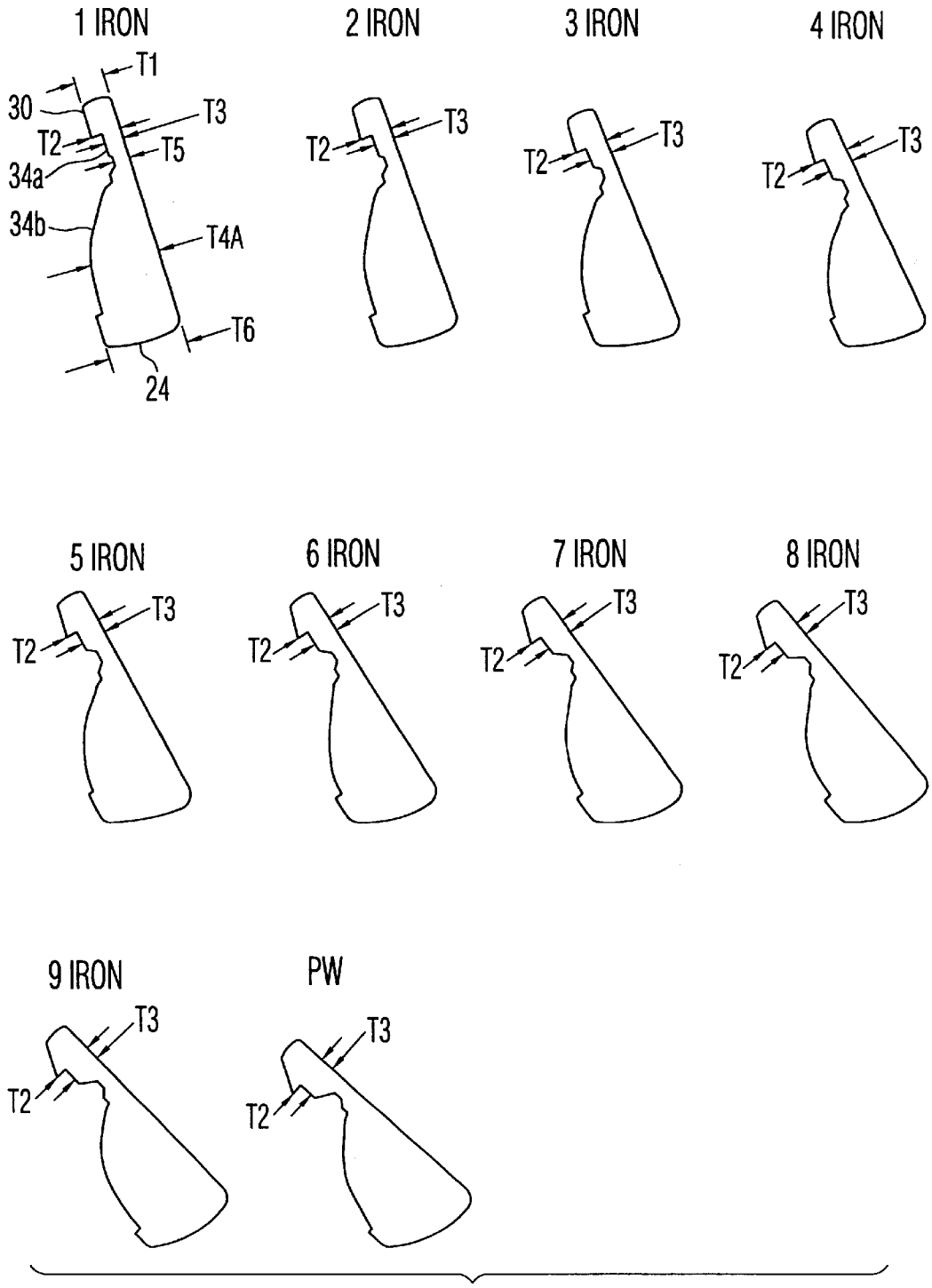
FIG. 6 is a set of cross-sectional views of a first embodiment of a set of golf club heads of the present invention.

Referring to FIG. 6, the first embodiment of a set shown includes irons numbered from 1 to 9 and the pitching wedge. In this set, the club length decreases from the long irons to the short irons, as discussed above, so that the length progressively decreases through the set from the long irons to the short irons, as know by those of ordinary skill in the art. In this set the height of each club head increases at the toe end, the blade length increases, the lie angle substantially increases, and the sole width of the bottom surface of the sole increases from the long irons to the short irons. Furthermore, in the set 48 (as shown in FIG. 5) and the set shown in FIG. 6, the loft angle θ (as shown in FIG. 3) for each club increases through the set from the long irons to the short irons as known by those of ordinary skill in the art.

Figure 7:
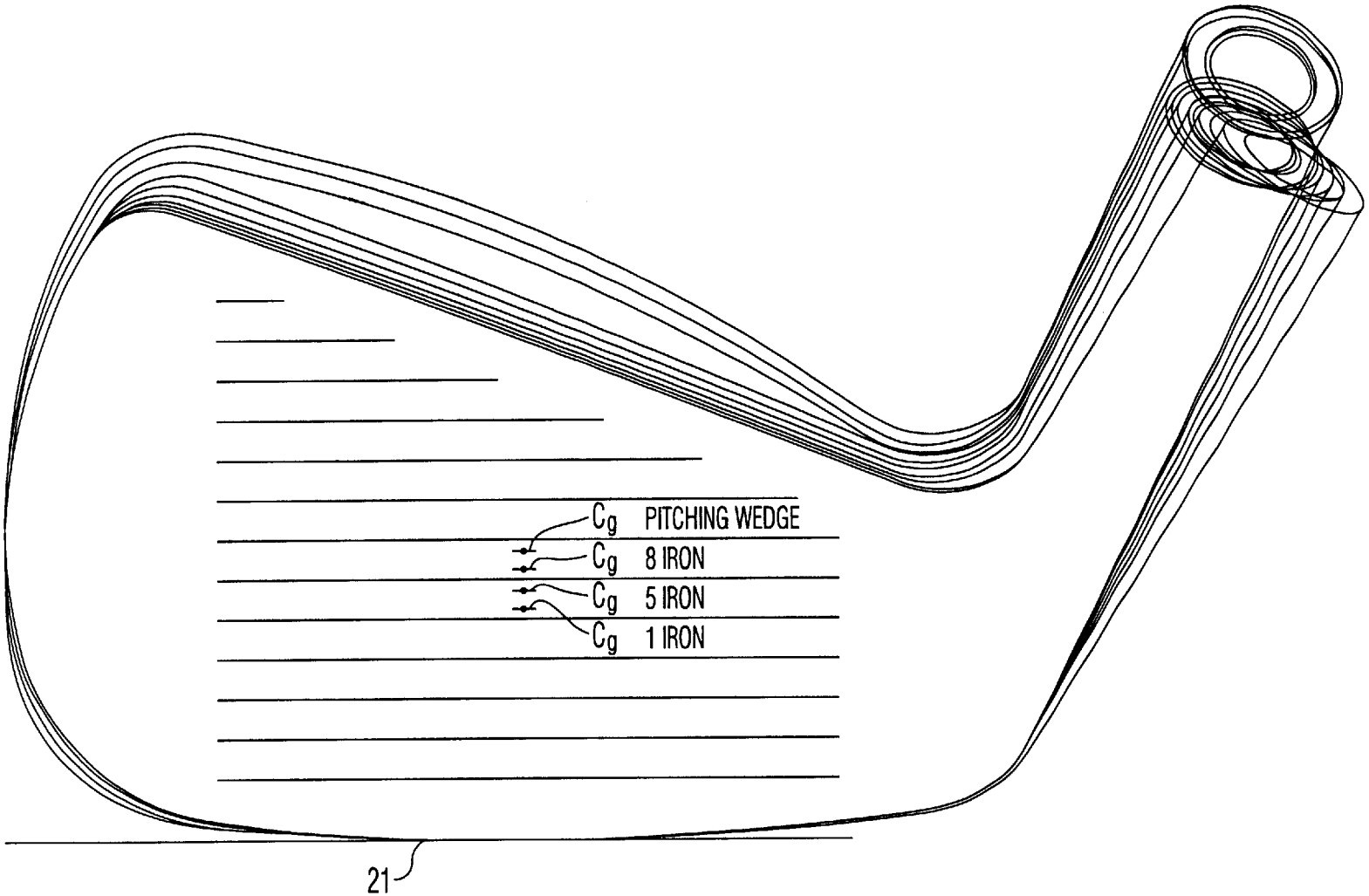
FIG. 7 is a schematic, front view of a portion of the set of golf club heads of FIG. 6.

Referring to FIGS. 3 and 6, in order to have a generally consistent peak trajectory along a line throughout the set, the center of gravity of each club varies throughout the set. Referring to FIG. 7, the center of gravity for the 1 iron, 5 iron, 8 iron, and pitching wedge for the set of irons of FIG. 6 are shown as $Cg_1$, $Cg_5$, $Cg_8$, and $Cg_{pw}$, respectively. The center of gravity is lowest in the long irons and rises generally in a vertical direction from the long irons to the short irons. The center of gravity is manipulated in order to provide a generally consistent peak trajectory along a line throughout the set, as discussed below.

Varying the center of gravity in this manner is accomplished by varying the upper and lower thicknesses of the club head. In this embodiment, the thickness T2 of the top line 30 and the thickness T3 of the upper weight 34*a* are increased from the long irons to the short irons. The thicknesses T4A and T4B of the lower weight 34*b* are kept substantially constant from the long irons to the short irons. The strike face thickness T5 of the head is also kept substantially constant from the long irons to the short irons. The thickness T1 of the upper surface for each club head is kept substantially constant from the long irons to the short irons. As a result, when a golfer looks down at the top line of the club head, the golfer views a substantially consistent top line thickness throughout the set. The thickness of the top line is varied by varying the thickness T2 of the top line below the upper surface upper weight 34*a*. The thickness T2 is varied on an angle on the golfer's line of sight so that the upper surface thickness T1 appears the same to the golfer throughout the set. The thickness T6 of the sole 24 is substantially constant throughout the set when measured perpendicular to the front face. However, in another embodiment the sole thickness can be varied to achieve the goals of the present invention.

In the first embodiment, the club heads are cast so that the peripheral weight, cavity weight and club head are integral and formed of one material. The club heads can be cast or forged from 431 Stainless Steel or other materials including alloys well known by those of ordinary skill in the art of making clubs. The clubs can also be formed in one or more parts that are joined by various methods, for example but not limited to welded, silver soldered, brazed, or mechanically fastened with fasteners.

In another embodiment, the set of the first embodiment can be modified so that the thickness of the lower weight can be decreased from the long irons to the short irons to further move the centers of gravity in the set. In yet another embodiment, the set of the first embodiment can be modified so that the top line thicknesses T1 and T2 are equal to one another in a single club, but the top line thickness increases from the long irons to the short irons.

EXAMPLE

These and other aspects of the present invention may be more fully understood with reference to the following non-limiting example which is merely illustrative of the preferred embodiment of the present invention set of golf clubs, and is not to be construed as limiting the invention, the scope of which is defined by the appended claims.

Table I provides exemplary, non-limiting dimensions for the various measurements of the clubs shown in FIG. 6.

TABLE I

| Club Number | T1 (inches) | T2 (inches) | T3 (inches) | T5 (inches) | Cg Vertical (inches) |
|---|---|---|---|---|---|
| 1 iron | 0.200 | 0.200 | 0.130 | 0.100 | 0.77 |
| 2 iron | 0.200 | 0.208 | 0.138 | 0.100 | 0.78 |
| 3 iron | 0.200 | 0.216 | 0.146 | 0.100 | 0.79 |
| 4 iron | 0.200 | 0.224 | 0.154 | 0.100 | 0.82 |
| 5 iron | 0.200 | 0.232 | 0.162 | 0.100 | 0.84 |
| 6 iron | 0.200 | 0.240 | 0.170 | 0.100 | 0.86 |
| 7 iron | 0.200 | 0.248 | 0.178 | 0.100 | 0.88 |
| 8 iron | 0.200 | 0.256 | 0.186 | 0.100 | 0.93 |

TABLE I-continued

| Club Number | T1 (inches) | T2 (inches) | T3 (inches) | T5 (inches) | Cg Vertical (inches) |
|---|---|---|---|---|---|
| 9 iron | 0.200 | 0.264 | 0.194 | 0.100 | 0.96 |
| PW | 0.200 | 0.272 | 0.202 | 0.100 | 0.98 |

As shown from Table I, the thickness T1 of the upper surface of the top line is substantially constant from the long irons to the short irons. The thickness T2 of the top line increases from the long irons to the short irons by increments of 0.008 inches. The thickness T3 of the upper weight increases from the long irons to the short irons by increments of 0.008 inches. The thicknesses T4A and T5 are substantially constant. Cg Vertical is measured from the leading edge 21 (as shown in FIG. 7) to the center of gravity of the club. The overall result of increasing the top line and upper cavity weight thicknesses from the long irons to the short irons is to move the center of gravity from a lower position to a higher position from the long to the short irons, as evidenced by the center of gravity measurements above. Although various dimensions are described as being substantially constant throughout the set these values may vary due to reasonable casting or forging tolerances and finishing tolerances.

Figure 8:
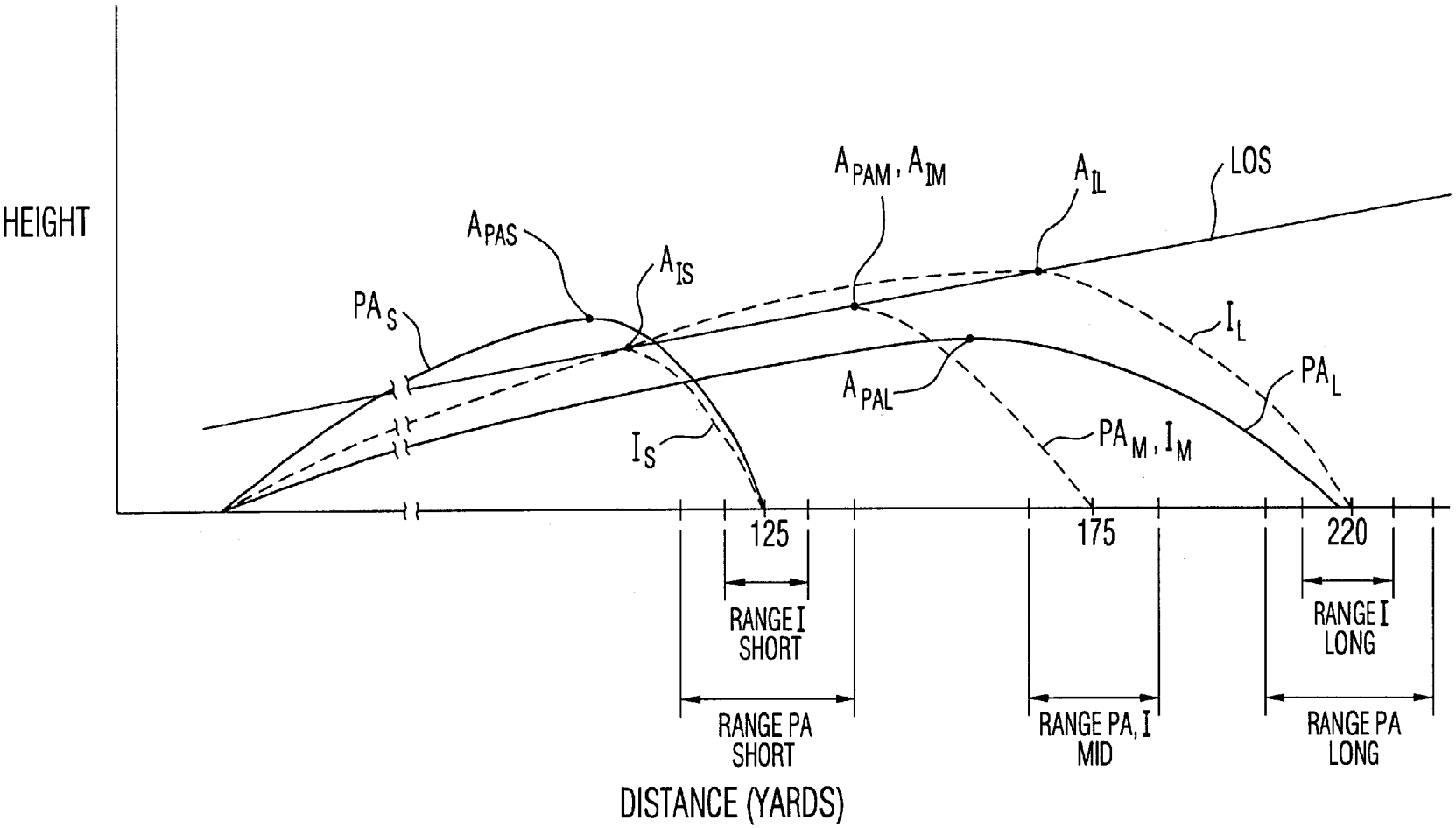
FIG. 8 is a graph showing ball flight trajectories achieved with various prior art clubs as compared to ball flight trajectories achieved with various clubs of the present invention from the set shown in FIG. 5.

Referring to FIG. 8, ball flight trajectories of prior art clubs are compared to the ball flight trajectories of clubs formed according to the present invention. FIG. 8 is a graph of Height versus Distance. The line LOS represents the line of sight of a golfer viewing each ball in flight. The ball flight trajectories labeled $PA_S$, $PA_M$, $PA_L$ represent the ball flight trajectories exhibited by balls hit by a set of prior art short-irons, mid-irons and long-irons, respectively. The ball flight trajectories labeled $I_S$, $I_M$, $I_L$ represent the ball flight trajectories exhibited by balls hit by a set of short-irons, mid-irons and long-irons, respectively, formed according to the present invention. Each prior art ball trajectory includes an apex or peak trajectory height of the flight labeled $A_{PAS}$, $A_{PAM}$, and $A_{PAL}$ for each of the short-, mid- and long-irons. Each inventive ball trajectory includes an apex or highest point of the flight labeled $A_{IS}$, $A_{IM}$, and $A_{IL}$ for each of the short-, mid- and long-irons.

Referring to FIG. 8, the ball flight trajectory for the prior art short-irons $PA_S$ has the apex $A_{PAS}$ which is above the golfer's line of sight LOS. The ball flight trajectory for the inventive short-irons $I_S$ has the apex $A_{IS}$ which is approximately at the golfer's line of sight LOS. The impact angle at which the ball hits the ground depends on whether there is a tail wind or a head wind, which consequently affects the range of impact that the ball exhibits. It is believed that the range of impact for the prior art short-irons may be about 6 yards, and the range of impact for the inventive short-irons may about 3 yards which is a decrease of about 50%. As a result of the apex of the inventive club being aligned with the golfer's line of sight, it is less susceptible to head or tail winds so that the range of impact is more narrow, thus the golfer has better control over flight distance with the new short irons. Furthermore, since the prior art apex $A_{PAS}$ is so high when compared to the apex $A_{IS}$, golfers tend to adjust their swing or choose a club with less loft to reduce the apex, particularly in windy conditions. The inventive clubs do not require the golfer to change their swing or club.

Referring to FIG. 8, the ball flight trajectory for the prior art mid-irons $PA_M$ has the apex $A_{PAM}$ and the ball flight trajectory for the inventive mid-irons $I_M$ has the apex $A_{IM}$. Both the apex $A_{PAM}$ and $A_{IM}$ are approximately at the golfer's line of sight LOS. The range of impact for the prior art mid-irons and the inventive mid-irons are about the same.

Referring to FIG. 8, the ball flight trajectory for the prior art long-irons $PA_L$ has the apex $A_{PAL}$ which is below the golfer's line of sight LOS. The ball flight trajectory for the inventive long-irons $I_L$ has the apex $A_{IL}$ which is approximately at the golfer's line of sight LOS. Since the initial ball flight of the prior art long irons is so penetrating, balls hit with such irons have a tendency to roll when they impact the ground. As a result, the range of impact, which includes the carry and the roll distance for the ball, for the prior art long irons depends on the topography of the golf course, which would determine where the ball would come to a stop. It is believed that the range of impact for the prior art long-irons may be about 12 yards, and the range of impact for the inventive long-irons may be about 6 yards which is a decrease of about 50%. As a result of the apex of the inventive club being aligned with the golfer's line of sight, the ball comes in more normal to the ground than a ball hit with the prior art long iron, resulting in a narrower range of impact where the ball will come to a rest. The inventive balls decrease possible range of carry distances exhibited by the ball, which consequently decreases the roll distances exhibited by the ball.

Since the short-, mid-, and long-irons of the inventive set now exhibit ball flight trajectories with apexes on the golfer's line of sight, the trajectories appear more consistent along a line throughout the set to the golfer. Thus, by varying the center of gravity of each club head from the long irons to the short irons according to the present invention, the peak trajectory height along a line appears substantially consistent from club-to-club in the set.

Figure 9:
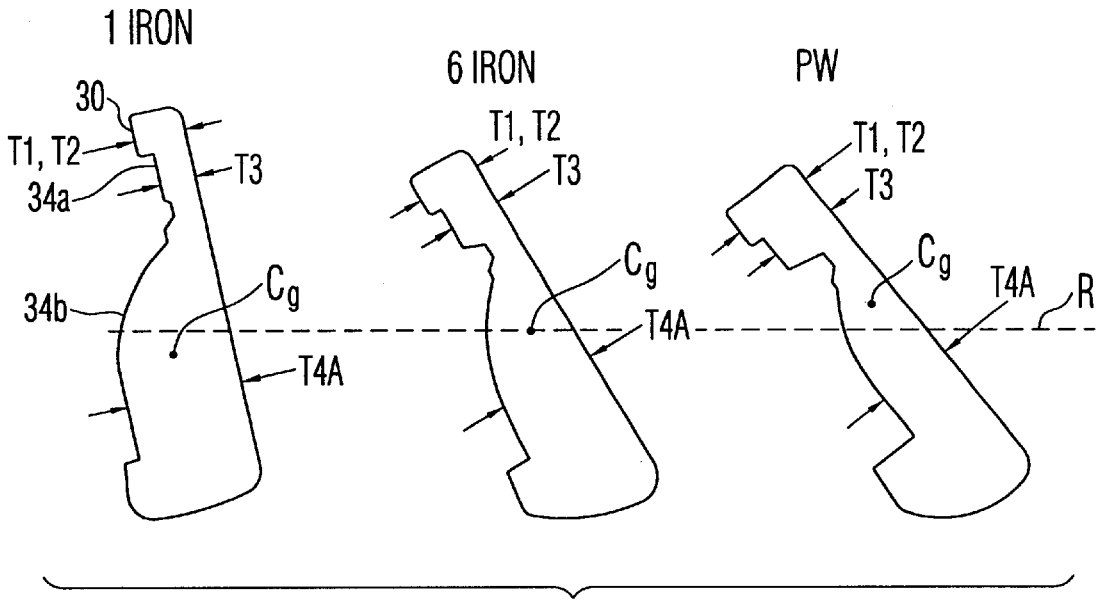
FIGS. 9–17 are of cross-sectional views of various embodiments of sets of golf club heads of the present invention.

Referring to FIG. 9, a second embodiment of a set of golf clubs of the present invention is represented by a 1 iron, 6 iron and pitching wedge (PW) shown. The maximum thickness T4A of the lower weight 34*b* decreases from the long irons to the short irons, consequently the total thickness of the lower weight 34*b* decreases from the long irons to the short irons. The thickness T3 of the upper weight 34*a* increases from the long irons to the short irons. Thus, the thickness of the lower weight 34*b* and upper weight 34*a* are inversely proportional from the long irons to the short irons. The thickness T1, T2 of the top line 30 increases from the long irons to the short irons. The thicknesses T1 and T2 are equal for each club. As a result of varying the thicknesses of the cavity weights and top line, the center of gravity rises from the long irons to the short irons so that the peak trajectory height along a line throughout the set appears generally consistent. The center of gravity Cg of the 6 iron defines a reference line R, and the center of gravity Cg of the 1 iron is below the line R, while the center of gravity Cg of the pitching wedge is above the line R. When the 1 iron, 6 iron and PW of the set of FIG. 9 are incorporated into a set of irons shown in FIG. 5, the center of gravity rises from the long irons to the short irons.

Figure 10:
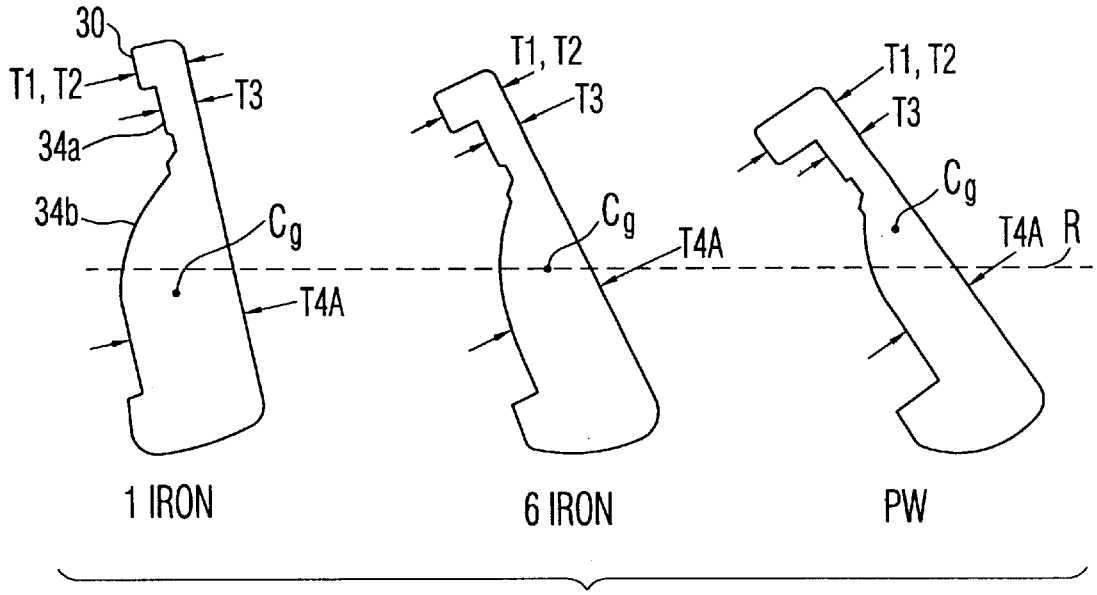

Referring to FIG. 10, a third embodiment of a set of golf clubs of the present invention is represented by a 1 iron, 6 iron and pitching wedge (PW) illustrated. The maximum thickness T4A of the lower weight 34*b* decreases from the long irons to the short irons, consequently the total thickness of the lower weight 34*b* decreases from the long irons to the short irons. The thickness T3 of the upper weight 34*a* is constant from the long irons to the short irons. The thickness of the top line T1, T2 increases from the long irons to the short irons. The thicknesses T1 and T2 are equal for each club. As a result of varying the thicknesses of the lower weight and top line, the center of gravity rises from the long irons to the short irons so that the peak trajectory height along a line throughout the set appears generally consistent. The center of gravity Cg of the 6 iron defines a reference line R, and the center of gravity Cg of the 1 iron is below the line R, while the center of gravity Cg of the pitching wedge is above the line R. When the 1 iron, 6 iron and PW of the set of FIG. 10 are incorporated into a set of irons shown in FIG. 5, the center of gravity rises from the long irons to the short irons.

Figure 11:
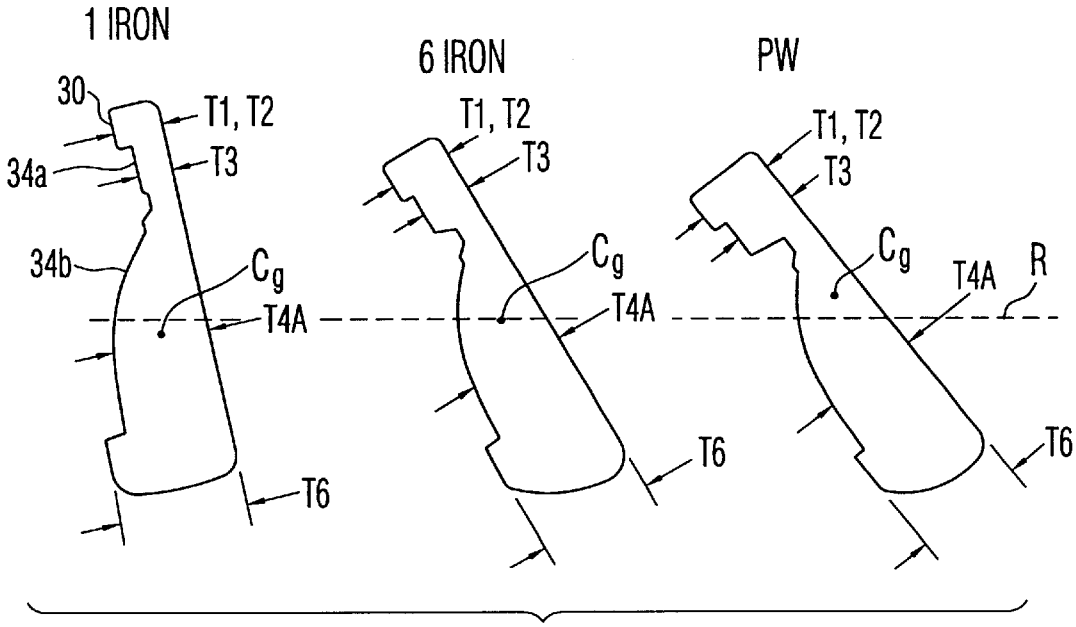

Referring to FIG. 11, a fourth embodiment of a set of golf clubs of the present invention is represented by a 1 iron, 6 iron and pitching wedge (PW) illustrated. The maximum thickness T4A of the lower weight 34*b* is constant from the long irons to the short irons. The thickness T3 of the upper weight 34*a* increases from the long irons to the short irons. The thickness T1, T2 of the top line increases from the long irons to the short irons. The thicknesses T1 and T2 are equal for each club. The thickness T6 of the sole decreases from the long irons to the short irons. As a result of varying the thickness of the upper weight, the top line, and the sole, the center of gravity rises from the long irons to the short irons so that the peak trajectory height along a line throughout the set appears generally consistent. The center of gravity Cg of the 6 iron defines a reference line R, and the center of gravity Cg of the 1 iron is below the line R, while the center of gravity Cg of the pitching wedge is above the line R. When the 1 iron, 6 iron and PW of the set of FIG. 11 are incorporated into a set of irons shown in FIG. 5, the center of gravity rises from the long irons to the short irons.

In another embodiment, the set of the fourth embodiment can be modified so that the thickness of lower weight decreases from the long irons to the short irons. In yet another embodiment, the set of the fourth embodiment can be modified so that the thickness of the upper weight is held constant from the long irons to the short irons.

Figure 12:
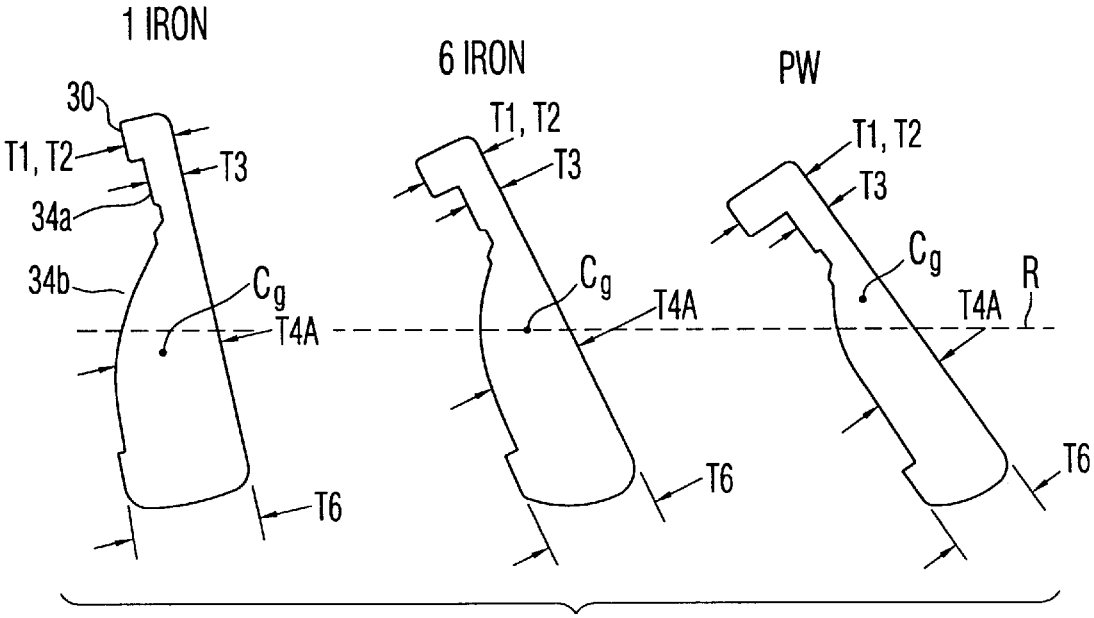

Referring to FIG. 12, a fifth embodiment of a set of golf clubs of the present invention is represented by a 1 iron, 6 iron and pitching wedge (PW) illustrated. The maximum thickness T4A of the lower weight 34*b* decreases from the long irons to the short irons, consequently the total thickness of the lower weight 34*b* decreases from the long irons to the short irons. The thickness T3 of the upper weight 34*a* is constant from the long irons to the short irons. The thicknesses T1, T2 of the top line 30 increase from the long irons to the short irons, and the thicknesses T1 and T2 are equal for each club. The thickness T6 of the sole decreases from the long irons to the short irons. As a result of varying the thicknesses of the lower weight, the top line, and the sole, the center of gravity rises from the long irons to the short irons so that the peak trajectory height along a line throughout the set appears generally consistent. The center of gravity Cg of the 6 iron defines a reference line R, and the center of gravity Cg of the 1 iron is below the line R, while the center of gravity Cg of the pitching wedge is above the line R. When the 1 iron, 6 iron and PW of the set of FIG. 12 are incorporated into a set of irons shown in FIG. 5, the center of gravity rises from the long irons to the short irons.

In another embodiment, the set of the fifth embodiment can be modified so that the thickness of upper weight increases from the long irons to the short irons.

Figure 13:
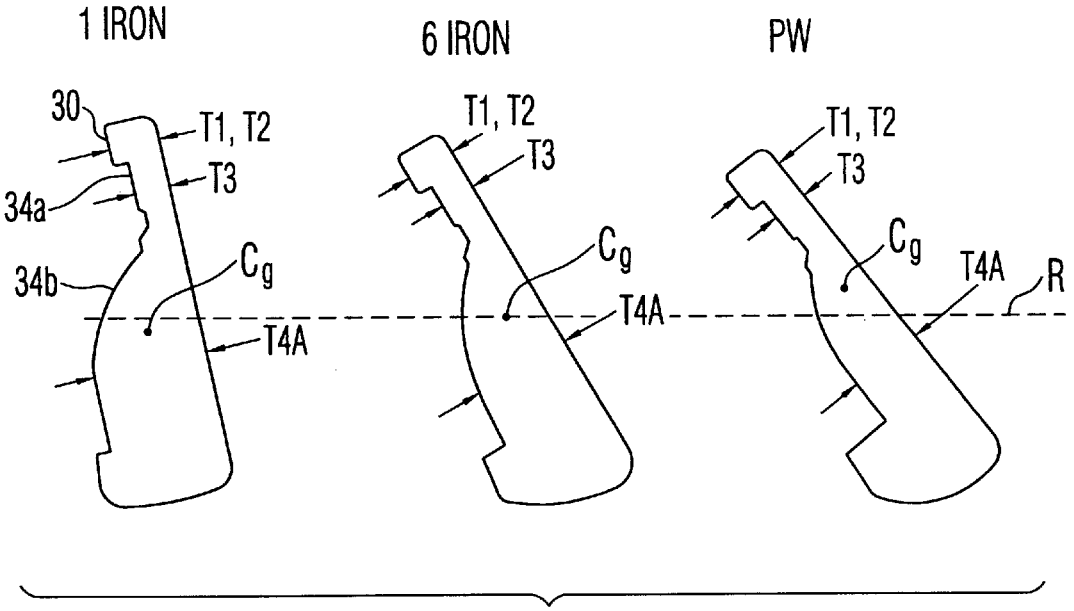

Referring to FIG. 13, a sixth embodiment of a set of golf clubs of the present invention is represented by a 1 iron, 6 iron and pitching wedge (PW) illustrated. The maximum thickness T4A of the lower weight 34*b* decreases from the long irons to the short irons, consequently decreases from the long irons to the short irons. The thickness T3 of the upper weight 34*a* is constant from the long irons to the short irons. The thicknesses T1, T2 of the top line is constant from the long irons to the short irons. The thicknesses T1 and T2 are equal for each club. As a result of varying the thickness of the lower weight, the center of gravity rises from the long irons to the short irons so that the peak trajectory height along a line throughout the set appears generally consistent. The center of gravity Cg of the 6 iron defines a reference line R, and the center of gravity Cg of the 1 iron is below the line R, while the center of gravity Cg of the pitching wedge is above the line R. When the 1 iron, 6 iron and PW of the set of FIG. 13 are incorporated into a set of irons shown in FIG. 5, the center of gravity rises from the long irons to the short irons.

In another embodiment, the set of the sixth embodiment can be modified so that the thicknesses of the sole and/or lower peripheral weight decrease from the long irons to the short irons. In yet another embodiment, the set of the sixth embodiment can be modified so that the thickness of the lower weight is constant and the thickness of the upper weight increases from the long irons to the short irons.

Figure 14:
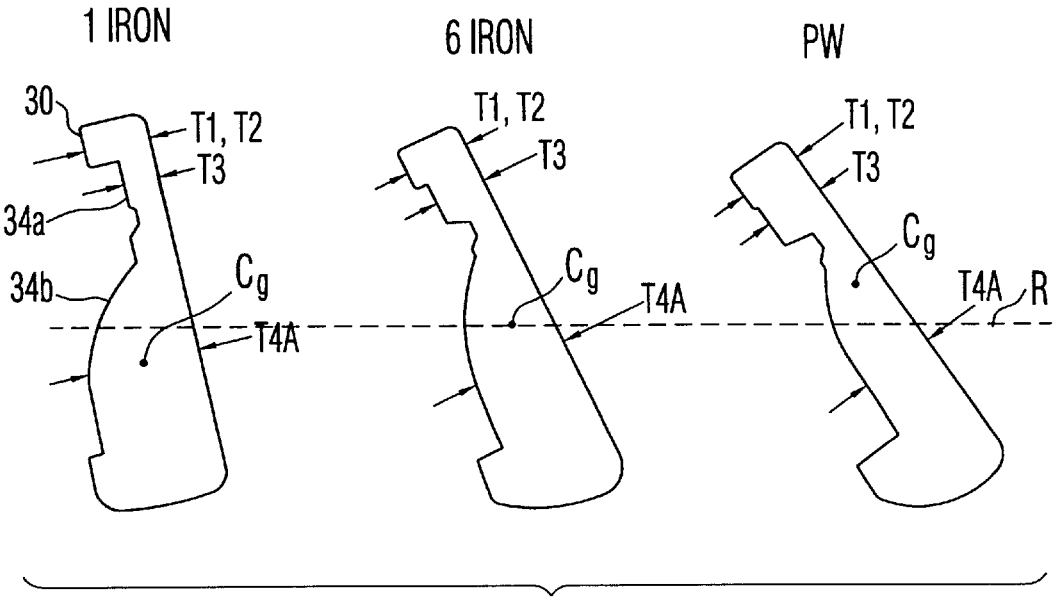

Referring to FIG. 14, a seventh embodiment of a set of golf clubs of the present invention is represented by a 1 iron, 6 iron and pitching wedge (PW) illustrated. The maximum thickness T4A of the lower weight 34*b* decreases from the long irons to the short irons, consequently the total thickness of the lower weight 34*b* decreases from the long irons to the short irons. The thickness T3 of the upper weight 34*a* increases from the long irons to the short irons. The thicknesses T1, T2 of the top line 30 is constant from the long irons to the short irons. As a result of varying the thickness of the lower and upper weights, the center of gravity rises from the long irons to the short irons so that the peak trajectory height along a line throughout the set appears generally consistent. The center of gravity Cg of the 6 iron defines a reference line R, and the center of gravity Cg of the 1 iron is below the line R, while the center of gravity Cg of the pitching wedge is above the line R. When the 1 iron, 6 iron and PW of the set of FIG. 14 are incorporated into a set of irons shown in FIG. 5, the center of gravity rises from the long irons to the short irons.

In another embodiment, the set of the seventh embodiment can be modified so that the thicknesses of the sole and/or lower peripheral weight decrease from the long irons to the short irons.

Figure 15:
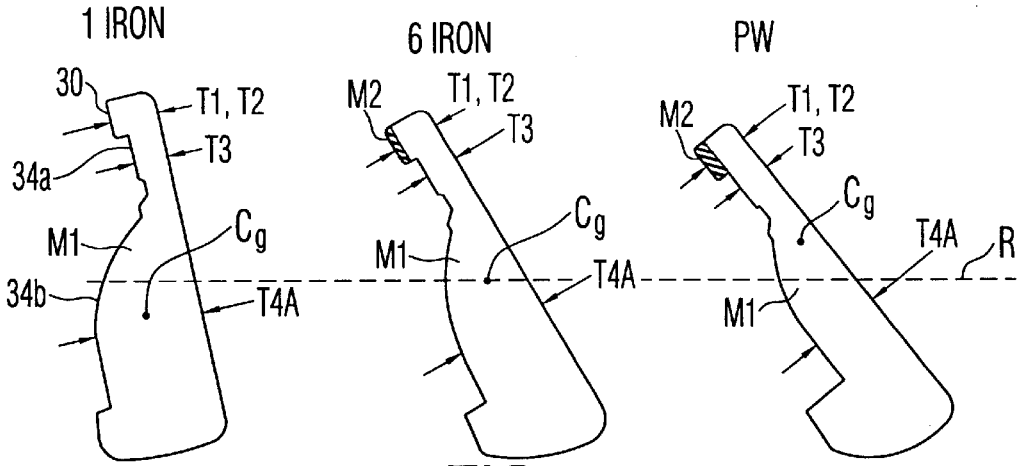

Referring to FIG. 15, a eighth embodiment of a set of golf clubs of the present invention is represented by a 1 iron, 6 iron and pitching wedge (PW) illustrated. The maximum thickness T4A of the lower weight decreases from the long irons to the short irons, consequently the total thickness of the lower weight 34*b* decreases from the long irons to the short irons. The thickness T3 of the upper weight 34*a* is constant from the long irons to the short irons. The thicknesses T1, T2 of the top line 30 is constant from the long irons to the short irons. The majority of the club head is formed of a first material M1 and a small amount of a second material M2 replaces the first material M1 that formed the top line of the 6 iron and the pitching wedge (PW). The first material M1 is less dense than the second material M2. The amount of second material M2 increases from the long irons to the short irons. As a result of varying the thickness of the lower weight, and increasing the amount of a dense second material on the top line from the long irons to the short irons, the center of gravity is lowest in the long irons and rises from the long irons to the short irons so that the peak trajectory height along a line throughout the set appears generally consistent. The center of gravity Cg of the 6 iron defines a reference line R, and the center of gravity Cg of the 1 iron is below the line R, while the center of gravity Cg of the pitching wedge is above the line R. When the 1 iron, 6 iron and PW of the set of FIG. 15 are incorporated into a set of irons shown in FIG. 5, the center of gravity rises from the long irons to the short irons.

Recommended first materials M1 include, but are not limited to, titanium, aluminum, stainless steel or metal alloys, or composite materials. Composite materials can include various resins combined with matrix material, for example thermoplastic or thermosetting resins or the like combined with a fiber glass, graphite, ceramic matrix or the like. Recommended second materials M2 include, but are not limited to, tungsten, copper, brass, or alloys thereof. The second material can be applied by flame spraying onto the club head formed of the first material.

In another embodiment, the set of the eighth embodiment can be modified so that the thicknesses of the sole and/or lower peripheral weight decrease from the long irons to the short irons, and/or the thicknesses of the upper weight and top line from the long irons to the short irons. In yet another embodiment, the set of the eighth embodiment can be modified so that the thickness of the lower weight is constant from the long irons to the short irons. In another embodiment, the set of the eighth embodiment can be modified so that the upper weight has the second material thereon, and the amount of the second material increases from the long irons to the short irons. The second material on the upper weight can be used in combination with the second material on the upper portion of the peripheral weight or without the second material on the upper portion.

Figure 16:
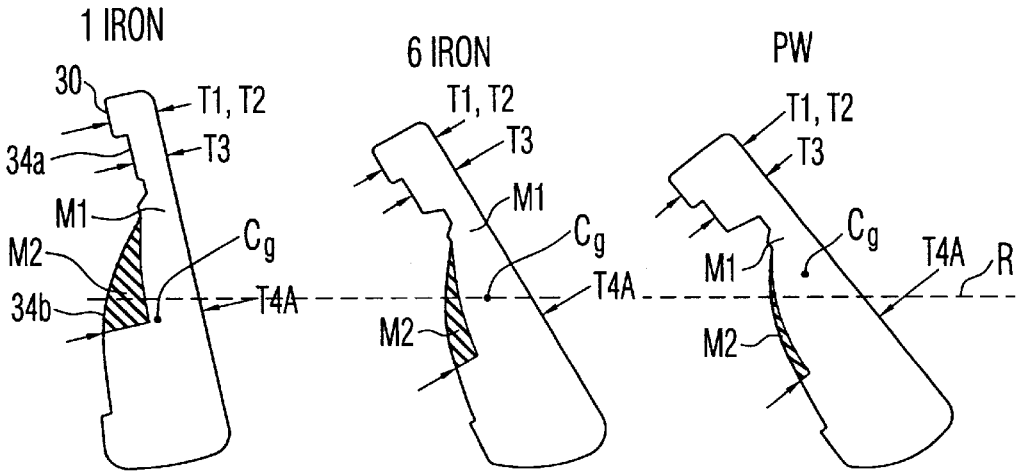

Referring to FIG. 16, a ninth embodiment of a set of golf clubs of the present invention is represented by a 1 iron, 6 iron and pitching wedge (PW) illustrated. The maximum thickness T4A of the lower weight 34*b* is constant from the long irons to the short irons. The thickness T3 of the upper weight 34*a* increases from the long irons to the short irons. The thicknesses T1, T2 of the top line 30 increase from the long irons to the short irons. The thicknesses T1 and T2 for each club head are equal. The majority of the club head is formed of a first material M1 and a small amount of a second material M2 replaces the first material that formed the lower weight. Therefore, the second material does not change the height of the iron. The first material M1 is less dense than the second material M2. The amount of second material M2 decreases from the long irons to the short irons. As a result of varying the thickness of the upper weight and top line, and adding a decreasing amount of a dense second material to the lower weight from the long irons to the short irons, the center of gravity rises from the long irons to the short irons so that the peak trajectory height along a line throughout the set appears generally consistent. The center of gravity Cg of the 6 iron defines a reference line R, and the center of gravity Cg of the 1 iron is below the line R, while the center of gravity Cg of the pitching wedge is above the line R. When the 1 iron, 6 iron and PW of the set of FIG. 16 are incorporated into a set of irons shown in FIG. 5, the center of gravity rises from the long irons to the short irons.

In another embodiment, the set of the ninth embodiment can be modified so that the thicknesses of the sole and/or lower peripheral weight decrease from the long irons to the short irons, and/or the thicknesses of the upper weight and/or top line are constant from the long irons to the short irons. In yet another embodiment, the set of the ninth embodiment can be modified so that the thickness of the lower weight decreases from the long irons to the short irons.

Figure 17:
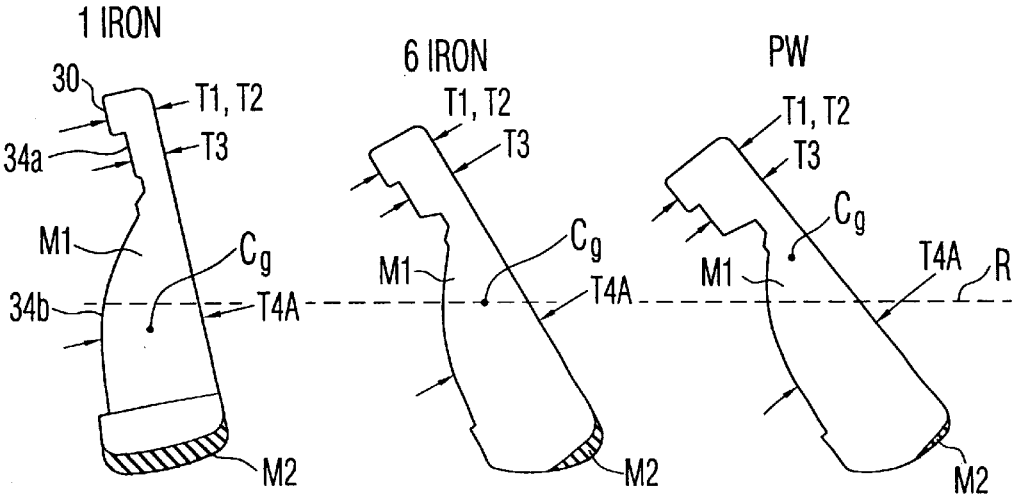

Referring to FIG. 17, a tenth embodiment of a set of golf clubs of the present invention is represented by a 1 iron, 6 iron and pitching wedge (PW) illustrated. The maximum thickness T4A of the lower weight 34*b* is constant from the long irons to the short irons. The thickness T3 of the upper weight 34*a* increases from the long irons to the short irons. The thicknesses T1, T2 of the top line 30 increase from the long irons to the short irons. The thicknesses T1 and T2 in this embodiment are equal. The majority of the club head is formed of a first material M1 and a small amount of a second material M2 is added to the sole. The first material M1 is less dense than the second material M2. The amount of second material M2 decreases from the long irons to the short irons. As a result of varying the thickness of the upper weight and top line, and adding a decreasing amount of a dense second material to the sole from the long irons to the short irons, the center of gravity rises from the long irons to the short irons so that the peak trajectory height along a line throughout the set appears generally consistent. The center of gravity Cg of the 6 iron defines a reference line R, and the center of gravity Cg of the 1 iron is below the line R, while the center of gravity Cg of the pitching wedge is above the line R. When the 1 iron, 6 iron and PW of the set of FIG. 17 are incorporated into a set of irons shown in FIG. 5, the center of gravity rises from the long irons to the short irons.

In another embodiment, the set of the tenth embodiment can be modified so that the thicknesses of the sole and/or lower peripheral portion decrease from the long irons to the short irons, and/or the thicknesses of the upper weight and/or top line are constant from the long irons to the short irons. In yet another embodiment, the set of the tenth embodiment can be modified so that the thickness of the lower weight decreases from the long irons to the short irons.

Figure 18:
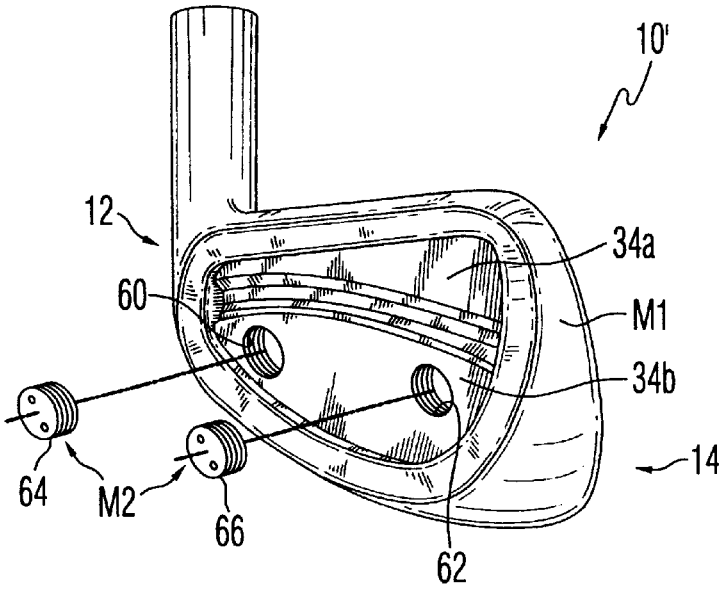
FIG. 18 is an exploded, back, perspective view of another embodiment of a golf club head of the present invention.
Figure 19:
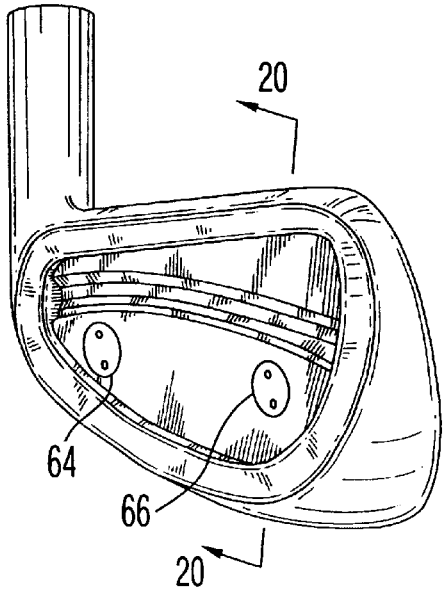
FIG. 19 is a back, perspective view of the golf club head of FIG. 18, wherein the weight screws are in an installed position.

Referring to FIGS. 18 and 19, another embodiment of a golf club head 10' is shown. The golf club head 10' is similar to the golf club head 10 discussed with respect to FIGS. 1–4; however, the golf club head 10' has been modified to include two internally, threaded bores 60 and 62 in the lower weight 34*b*. The threaded bore 60 is adjacent the heel 12 and the bore 62 is adjacent the toe 14. The threaded bores 60 and 62 receive externally, threaded weight screws 64 and 66, respectively. These screws can be glued for more securement. The majority of the club head is formed of a first material M1 and the threaded screws are formed of a second material M2. The first material M1 is less dense than the second material M2. The first and second materials can include those described with respect to the embodiments shown in FIGS. 15–17.

Figure 20:
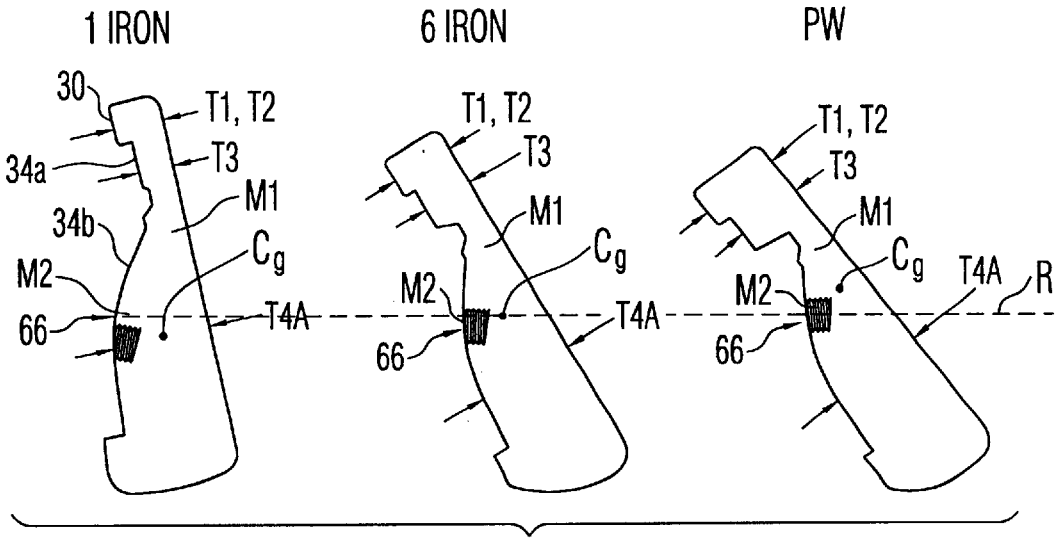
FIG. 20 is a set of cross-sectional views of a set of golf club heads with configurations similar to the head of FIG. 9 and taken along line 20—20 of FIG. 19.

Referring to FIGS. 18 and 20, the golf club head 10' is incorporated into an eleventh embodiment of a set of golf clubs of the present invention. The eleventh set of golf clubs of the present invention is represented by a 1 iron, 6 iron and pitching wedge (PW) illustrated. The maximum thickness T4A of the lower weight 34*b* is constant. The thickness T3 of the upper weight 34*a* increases from the long irons to the short irons. The thicknesses T1, T2 of the top line 30 increase from the long irons to the short irons. The thicknesses T1 and T2 in this embodiment are equal for each club. The majority of the club head is formed of the first material M1 and the weight screws 64 and 66 are formed of the second material M2 and added to the lower weight. The position of the screws rises from long irons to the short irons. As a result of varying the thickness of the upper weight and top line, and moving the weight screws upward from the long irons to the short irons, the center of gravity rises from the long irons to the short irons so that the peak trajectory height along a line throughout the set appears generally consistent. The center of gravity Cg of the 6 iron defines a reference line R, and the center of gravity Cg of the 1 iron is below the line R, while the center of gravity Cg of the pitching wedge is above the line R. When the 1 iron, 6 iron and PW of the set of FIG. 20 are incorporated into a set of irons shown in FIG. 5, the center of gravity rises from the long irons to the short irons.

In another embodiment, the set of the eleventh embodiment can be modified so that the weight screws are located in the upper weight. In another embodiment, the set of the eleventh embodiment can be modified so that the thicknesses of the sole and/or lower peripheral weight decrease from the long irons to the short irons, and/or the thicknesses of the upper weight and/or top line are constant from the long irons to the short irons. In yet another embodiment, the set of the eleventh embodiment can be modified so that the thickness of the lower weight decreases from the long irons to the short irons.

Figure 21:
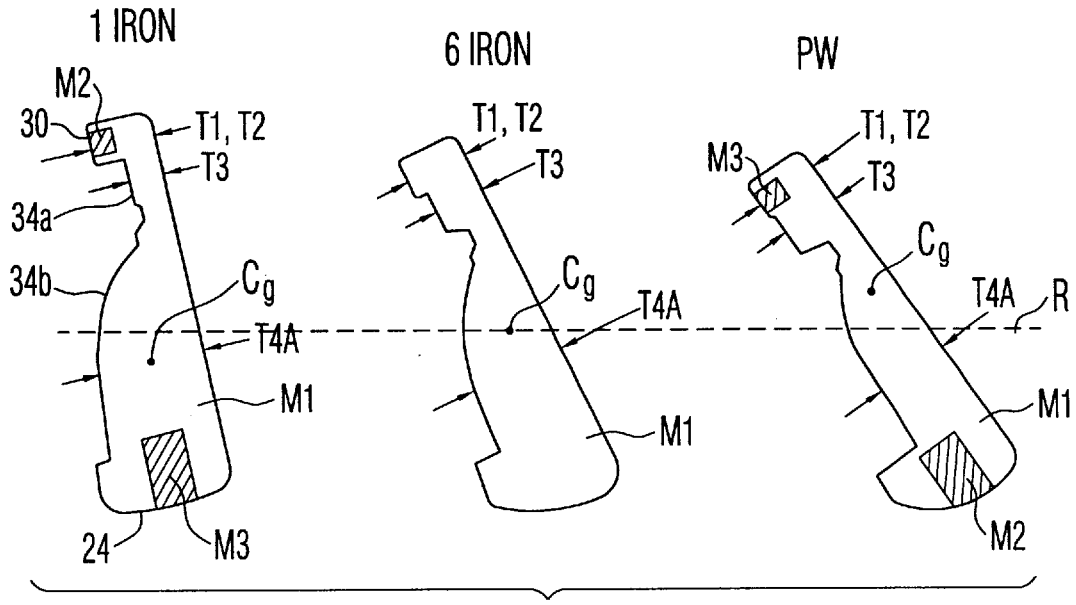
FIG. 21 is a set of cross-sectional views of another embodiment of a set of golf club heads of the present invention.

Referring to FIG. 21, a twelfth embodiment of a set of golf clubs of the present invention is represented by a 1 iron, 6 iron and pitching wedge (PW) illustrated. The maximum thickness T4A of the lower weight 34*b* decreases from the long irons to the short irons, consequently the total thickness of the lower weight 34*b* decreases from the long irons to the short irons. The thickness T3 of the upper weight 34*a* increases from the long irons to the short irons. The thicknesses T1, T2 of the top line 30 are constant from the long irons to the short irons. Furthermore, the 1 iron and the pitching wedge are substantially formed of a first material, and further include a second material M2 that is heavier than the first material, and a third material M3 that is lighter than the first material. On the 1 iron, the first material M1 is removed and replaced with the heavier material M3 located in the sole 24 and the second lighter material M2 located in the top line 30. On the pitching wedge, the first material Mlis removed and replaced with the heavier material M3 located in the top line 30 and the second lighter material M2 located in the sole 24. The 6 iron is formed of the first material. As a result of varying the thickness of the lower and upper weights and locating a heavier and lighter material in various places on each club, the center of gravity rises from the long irons to the short irons so that the peak trajectory height along a line throughout the set appears generally consistent. The center of gravity Cg of the 6 iron defines a reference line R, and the center of gravity Cg of the 1 iron is below the line R, while the center of gravity Cg of the pitching wedge is above the line R. When the 1 iron, 6 iron and PW of the set of FIG. 21 are incorporated into a set of irons shown in FIG. 5, the center of gravity rises from the long irons to the short irons. By using a heavier and a lighter material it is easier to remove the first material as necessary and still allow each club head to weigh the necessary amount.

While it is apparent that the illustrative embodiments of the invention disclosed herein fulfill the objectives stated above, it is appreciated that numerous modifications and other embodiments may be devised by those skilled in the art. The sets of clubs disclosed can include a series of wedges, each with a different loft, such as pitching, lob, gap and sand wedges. The features disclosed to vary the center of gravity, as discussed above, can be used in different combinations so that the objective of raising the center of gravity from the long irons to the short irons is achieved. The thickness of the top line can be varied by varying the upper top line thickness alone, by varying the lower top line thickness alone, or by varying both. Instead of varying the thickness of the lower weight by varying the entire thickness of the cavity weight, just a portion of the thickness of the cavity weights can be varied. On the other hand, the upper weight can be varied by varying the entire thickness of the weight or by varying just a portion of the thickness. Where a first material and a second more dense material are used, these materials can also be joined by brazing, bonding by for example epoxy, or by mechanical fasteners, such as pins.

Another modification, can be changing the center of gravity from the long irons to the short irons in subsets. Thus, for example a first group of long irons have a first center of gravity, a second group of mid irons have a second center of gravity, and a group of short irons have a third center of gravity. The vertical position of the center of gravity is about the same within a group, however, the first center of gravity is the lowest and the second and third centers of gravity increase from the first group to the third group. Therefore, it will be understood that the appended claims are intended to cover all such modifications and embodiments which would come within the spirit and scope of the present invention.

What is claimed is:

1. A set of golf club heads comprising at least a first club head and a second club head, the first and second club heads each comprising a heel, a toe, an upper surface, a lower surface, a front face, a back face opposite the front face, and a cavity including a cavity weight, the first club head further comprising a first loft angle and a first center of gravity, and the second club head further comprising a second loft angle and a second center of gravity, wherein the first loft angle is less than the second loft angle, the cavity weight of the first club head has a weight distribution different than the cavity weight of the second club head so that the first center of gravity is located at a first height and the second center of gravity is located at a second height, the first height being lower than the second height, with each cavity weight further including an upper weight disposed closer to the upper surface than the lower surface and a lower weight disposed between the upper weight and the lower surface, the back face of each club head further includes a peripheral weight for defining the cavity therein, the peripheral weight comprising an upper portion and a lower portion, and the upper weight of each club head extends from the upper portion of the peripheral weight to a gap within the cavity having gap ends proximate the heel and toe, and the lower weight of each club head extends from the lower portion of the peripheral weight to the gap.

2. The set of golf club heads of claim 1, wherein the lower weight of the first club head weighs the same as the lower weight of the second club head and the upper portion of the peripheral weight of the first club head weighs less than the upper portion of the peripheral weight of the second club head.

3. The set of golf club heads of claim 2, wherein the upper weight extends from the back face less on the first club than the second club.

4. The set of golf club heads of claim 3, wherein the upper portion of the peripheral weight extends from the back face less on the first club than the second club.

5. The set of golf club heads of claim 4, wherein each cavity weight extends across the entire cavity from the heel to the toe.

6. The set of golf club heads of claim 4, further including at least four club heads.

7. The set of golf club heads of claim 4, further including a 1 iron, a 2 iron, a 3 iron, a 4 iron, a 5 iron, a 6 iron, a 7 iron, a 8 iron, a 9 iron, and a pitching wedge.

8. The set of golf club heads of claim 6, wherein a rate of change of the center of gravity between each club is constant.

9. The set of golf club heads of claim 1, wherein the first club head further includes a first shaft connected thereto having a first length, and the second club head further includes a second shaft connected thereto having a second length, and the first length is greater than the second length.

10. A set of golf clubs comprising at least a first iron less than or equal to a six iron and a second iron greater than a six iron, the first and second irons each comprising a head with a heel, a toe, an upper surface, a lower surface, a front face, a back face opposite the front face, and a cavity including a cavity weight, the first iron further comprising a first shaft having a first shaft length, a first loft angle and a first center of gravity, and the second iron further comprising a second shaft having a second shaft length, a second loft angle and a second center of gravity, wherein the first shaft length is greater than the second shaft length and the first loft angle is less than the second loft angle, wherein the cavity weight comprises at least one lower weight disposed closer to the lower surface than the upper surface, and wherein each of the iron heads is formed of the same material and a single material, and the lower weight of the first iron weighs more than the lower weight of the second iron so that the first center of gravity is located at a first height and the second center of gravity is located at a second height, the first height being lower than the second height.

11. The set of golf clubs of claim 10, wherein each cavity further includes an upper weight disposed between the lower weight and the upper surface.

12. The set of golf clubs of claim 11, wherein the upper weight of the first club head weighs less than the upper weight of the second club head.

13. The set of golf clubs of claim 11, wherein the lower weight extends from the back face more on the first club than on the second club, and the upper weight extends from the back face less on the first club than on the second club.

14. The set of golf clubs of claim 12, wherein the back face of each club head further includes a peripheral weight for defining the cavity therein, the peripheral weight comprising an upper portion and a lower portion, and the upper weight of each club head extends from the upper portion of the peripheral weight to a gap within the cavity having gap ends proximate the heel and toe, and the lower weight of each club head extends from the lower portion of the peripheral weight to the gap.

15. A set of golf clubs comprising at least a first golf club and a second golf club, the first and second golf clubs each comprising a head with a heel, a toe, a front face, a back face opposite the front face, and a peripheral weight defining a cavity, the peripheral weight including an upper portion and a lower portion, the first golf club further comprising a first shaft having a first shaft length, a first loft angle, and a first center of gravity, and the second golf club further comprising a second shaft having a second shaft length, a second loft angle, and a second center of gravity, wherein the first length is greater than the second length and the first loft angle is less than the second loft angle, wherein the cavity comprises a groove extending proximate the heel and toe, and wherein the first golf club has a first peripheral weight with a first thickness and the second golf club has a second peripheral weight with a second thickness different from the first thickness, so that the first peripheral weight is less than the second peripheral weight, and the first center of gravity is located at a first height and the second center of gravity is located at a second height, the first height being lower than the second height.

16. A set of golf clubs comprising at least a first golf club and a second golf club, the first and second golf clubs each comprising a head with a heel, a toe, a front face, a back face opposite the front face, and a peripheral weight defining a cavity with a cavity weight therein, the first golf club further comprising a first shaft having a first shaft length and the first golf club head further comprising a first loft angle and a first center of gravity, and the second golf club further comprising a second shaft having a second shaft length and the second golf club head further comprising a second loft angle and a second center of gravity, wherein the first length is greater than the second length and the first loft angle is less than the second loft angle, wherein the cavity weight comprises lower and upper weights extending from the back face with a gap therebetween, and wherein each golf club head is formed substantially of a primary material and has a secondary material coupled thereto, the secondary material being more dense than the primary material, wherein the first club head comprises a first amount of secondary material, the second club head comprises a second amount of the secondary material, and the first amount is different from the second amount so that the first center of gravity is located at a first height and the second center of gravity is located at a second height, the first height being lower than the second height.

17. The set of golf clubs of claim 16, wherein the peripheral weight of each club head further includes an upper portion, the secondary material is located on the upper portion, and the first amount of the secondary material is less than the second amount of the secondary material.

18. The set of golf clubs of claim 16, wherein the secondary material is located on the upper weight, and the first amount of the secondary material is less than the second amount of the secondary material.

19. The set of golf clubs of claim 16, wherein the secondary material is located on the lower weight, and the first amount of the secondary material is greater than the second amount of the secondary material.

20. The set of golf clubs of claim 16, wherein each golf club further includes an upper surface and a lower surface, the secondary material is located on the lower surface, and the first amount of the secondary material is greater than the second amount of the secondary material.

21. The set of golf clubs of claim 16, wherein the secondary material is flame sprayed onto the primary material.

22. A golf club head comprising:

an upper surface and a lower surface spaced relative thereto, a peripheral weight comprising an upper portion and a lower portion, and further defining a cavity including at least two cavity weights therein, the cavity weights including an upper weight and a lower weight, wherein the upper and lower weights protrude from the back face, with the upper weight extending from the upper portion of the peripheral weight to a gap within the cavity having gap ends proximate the heel and toe, the lower weight extending from the gap to the lower portion of the peripheral weight, and the upper and lower weights extending across the entire cavity from the heel to the toe.

23. A set of golf clubs comprising:

at least two golf clubs, each club including a golf club head having a front face, a back face, and a periphery defining a cavity on the back face, a lower weight member in the cavity adjacent a lower portion of the periphery and having a first weight, an upper weight member in the cavity adjacent an upper portion of the periphery, and a gap disposed between the upper and lower weight members, the gap extending substantially across the cavity, wherein the first weight is varied between golf clubs in the set.

24. The golf club head of claim 22, wherein each club head has a plurality of thicknesses from the front face to the back face so that the club head has an upper weight thickness at the upper weight, a lower weight thickness at the lower weight, and a gap thickness at the gap, with the gap thickness being less than the upper and lower weight thicknesses.

25. The golf club of claim 15, wherein the first thickness is on an upper portion of the first peripheral weight and the second thickness is on an upper portion of the second peripheral weight.

26. A set of iron golf clubs for impacting a golf ball comprising:

at least three clubs selected from a 1 iron, a 2 iron, a 3 iron, a 4 iron, a 5 iron, a 6 iron, a 7 iron, an 8 iron, a 9 iron, a pitching wedge, a sand wedge, and a lob wedge, each club having a club face;

wherein peak trajectory heights of the golf ball after consistent impacts with the club faces follow a generally linear relation.

27. The set of iron golf clubs of claim 26, wherein the peak trajectory heights coincide with a line of sight.

* * * * *